US009228426B2

(12) United States Patent
Perkins et al.

(10) Patent No.: US 9,228,426 B2
(45) Date of Patent: Jan. 5, 2016

(54) UNDERGROUND COAL GASIFICATION WELL LINER

(71) Applicant: Linc Energy Ltd, Brisbane, Queensland (AU)

(72) Inventors: Greg Martin Parry Perkins, Brisbane (AU); Casper Jan Hendrik Burger, Brisbane (AU); Aman Prukash Chandra, Brisbane (AU)

(73) Assignee: Linc Energy Ltd., Brisbane, Queensland (AU)

( * ) Notice: Subject to any disclaimer, the term of this patent is extended or adjusted under 35 U.S.C. 154(b) by 0 days.

(21) Appl. No.: 14/363,278

(22) PCT Filed: Sep. 28, 2012

(86) PCT No.: PCT/AU2012/001185
§ 371 (c)(1),
(2) Date: Jun. 5, 2014

(87) PCT Pub. No.: WO2013/090975
PCT Pub. Date: Jun. 27, 2013

(65) Prior Publication Data

US 2015/0041125 A1 Feb. 12, 2015

(30) Foreign Application Priority Data

Dec. 21, 2011 (AU) ..... 2011905369

(51) Int. Cl.

| | |
|---|---|
| ***E21B 17/00*** | (2006.01) |
| ***E21B 43/295*** | (2006.01) |
| ***E21B 43/08*** | (2006.01) |
| ***E21B 43/243*** | (2006.01) |

(52) U.S. Cl.
CPC ..... *E21B 43/295* (2013.01); *E21B 17/00* (2013.01); *E21B 43/08* (2013.01); *E21B 43/243* (2013.01); *E21B 43/084* (2013.01)

(58) Field of Classification Search
CPC ..... E21B 43/243; E21B 43/305; E21B 17/00; E21B 43/08; E21B 43/086; E21B 43/10; E21B 43/295
See application file for complete search history.

(56) References Cited

U.S. PATENT DOCUMENTS

| | | | | | |
|---|---|---|---|---|---|
| 3,414,055 | A | * | 12/1968 | Vogt, Jr. | 166/276 |
| 4,551,155 | A | * | 11/1985 | Wood et al. | 48/197 R |
| 4,705,109 | A | | 11/1987 | Ledent et al. | |
| 4,714,117 | A | * | 12/1987 | Dech | 166/380 |
| 5,074,366 | A | * | 12/1991 | Karlsson et al. | 175/76 |
| 5,842,518 | A | * | 12/1998 | Soybel et al. | 166/287 |
| 7,174,764 | B2 | * | 2/2007 | Oosterling et al. | 72/370.06 |

(Continued)

FOREIGN PATENT DOCUMENTS

UA 63200 A 1/2004

OTHER PUBLICATIONS

International Search Report and Written Opinion, mailed Dec. 5, 2012, for corresponding International Application No. PCT/AU2012/001185, 8 pages.

*Primary Examiner* — Daniel P Stephenson
(74) *Attorney, Agent, or Firm* — Klarquist Sparkman, LLP

(57) ABSTRACT

The invention relates to compositions and method for construction of an underground coal gasification (UCG) well liner assembly. In particular, a well liner segment for use in the construction of a UCG well liner assembly for conveying product gas to a production well is disclosed. Also disclosed are a system and method for UCG product gas production.

5 Claims, 2 Drawing Sheets

(56) References Cited

U.S. PATENT DOCUMENTS

| | | | | |
|---|---|---|---|---|
| 7,571,771 | B2 * | 8/2009 | Pratt et al. | 166/313 |
| 2009/0183873 | A1 * | 7/2009 | Bunnell et al. | 166/278 |
| 2009/0283270 | A1 * | 11/2009 | Langeslag | 166/297 |
| 2010/0000742 | A1 * | 1/2010 | Bonner et al. | 166/378 |
| 2010/0299997 | A1 * | 12/2010 | Hoteit et al. | 48/210 |
| 2012/0103611 | A1 * | 5/2012 | Brandl et al. | 166/293 |
| 2012/0152528 | A1 * | 6/2012 | Greci | 166/227 |
| 2013/0146283 | A1 * | 6/2013 | Ayasse | 166/256 |
| 2013/0312950 | A1 * | 11/2013 | Shaikh et al. | 166/59 |
| 2014/0000878 | A1 * | 1/2014 | Davis et al. | 166/256 |
| 2015/0041121 | A1 * | 2/2015 | Hunt et al. | 166/250.12 |
| 2015/0041125 | A1 * | 2/2015 | Perkins et al. | 166/260 |

* cited by examiner

UNDERGROUND COAL GASIFICATION WELL LINER

CROSS REFERENCE TO RELATED APPLICATIONS

This is the U.S. National Stage of International Application No. PCT/AU2012/001185, filed Sep. 28, 2012, which in turn claims priority to and the benefit of Australian Application No. AU2011905369, filed Dec. 21, 2011.

TECHNICAL FIELD

The present invention relates to underground coal gasification (UCG). In particular, a well liner segment for use in the construction of a UCG well liner assembly for conveying product gas to a production well is disclosed. Also disclosed is a system and method for underground coal gasification product gas production.

BACKGROUND ART

Underground coal gasification is a process by which product gas is produced from a coal seam by heating the coal in situ in the presence of an oxidant (e.g., air or oxygen). The product gas is typically referred to as synthesis gas or syngas and can be used, for example, as a feedstock for various applications, including clean fuels production, chemical production, and electricity generation.

Conversion of coal into product gas takes place in a well that includes one or more bore holes drilled into the coal seam that are in fluidic communication with one another. Typically, that part of the well into which the oxidant is introduced to promote combustion is called an injection well and that part of the well from which product gas is withdrawn is called a production well. Both horizontal and vertical wells can be used for oxidant injection and product gas production.

A coal seam panel is typically referred to as a coal gasifier. Gasification occurs adjacent a combustion zone of the well/gasifier and the coal is partially oxidized to produce product gas of low or medium heating value. Hot product gas flows from the gasification zone and exits the ground via a well head of the production well.

Some of the major challenges in UCG include preventing blockage to the production well due to coal spalling, slugging or the ingress of water, controlling interaction of the product gas with the coal seam in well zones in which chemical reactions have not yet taken place (i.e., cold zones), reigniting the coal seam, and preventing the escape of product gas into the surrounding environment.

SUMMARY OF INVENTION

It is an object of the present invention to minimise or overcome one or more of the problems of the prior art.

In one aspect, the invention provides a well liner segment for use in the construction of an underground coal gasification well liner assembly, the segment including a UCG product gas-conveying pipe having opposed open ends for connection to like well liner segments and perforations located between the opposed open ends.

In one embodiment, the perforations are grouped together in one or more regions along the length of the UCG product gas-conveying pipe, alternating with non-perforated sections of the pipe.

In another embodiment, the well liner segment further includes a sheath. Suitably, the sheath is made of a combustible material or a material with a low melting temperature and covers at least some of the perforations in the UCG product gas-conveying pipe.

In another aspect, the invention provides an underground coal gasification well liner assembly including two or more well liner segments as set forth herein connected to one another.

In a further aspect, the invention provides a method of underground coal gasification in a coal seam provided with an injection well, a production well and an in-seam channel linking the injection well and the production well, including the steps of: a) extending at least one well liner assembly as defined herein within the coal seam between the injection well and the production well, b) igniting the coal seam using an ignition tool located within the well liner assembly, c) injecting oxidant into the linkage channel to maintain combustion of the coal seam, and d) withdrawing product gas from the production well.

In one embodiment, the coal seam is further provided with one or more service wells. The service wells are typically vertical wells located between the injection and production wells, and can be used as ignition wells and/or auxiliary injection/production wells.

In yet a further aspect, the invention provides a system for UCG product gas production, including: a) an underground coal seam, b) at least one injection well, c) at least one production well, d) an in-seam channel linking the injection well and the production well, and e) a well liner assembly including two or more well liner segments as set forth herein connected to one another.

In another aspect, the invention provides an underground coal gasification well liner assembly having two or more well liner segments connected to one another, wherein each well liner segment includes: a) a UCG product gas-conveying pipe having opposed open ends for connection to like well liner segments and perforations located between the opposed open ends, and b) a sheath.

In one embodiment, the perforations are grouped together in one or more regions along the length of the UCG product gas-conveying pipe, alternating with non-perforated sections of the pipe.

In order that the invention may be more readily understood and put into practice, one or more preferred embodiments thereof will now be described, by way of example only, with reference to the accompanying figures.

DESCRIPTION OF EMBODIMENTS

Figure 1:
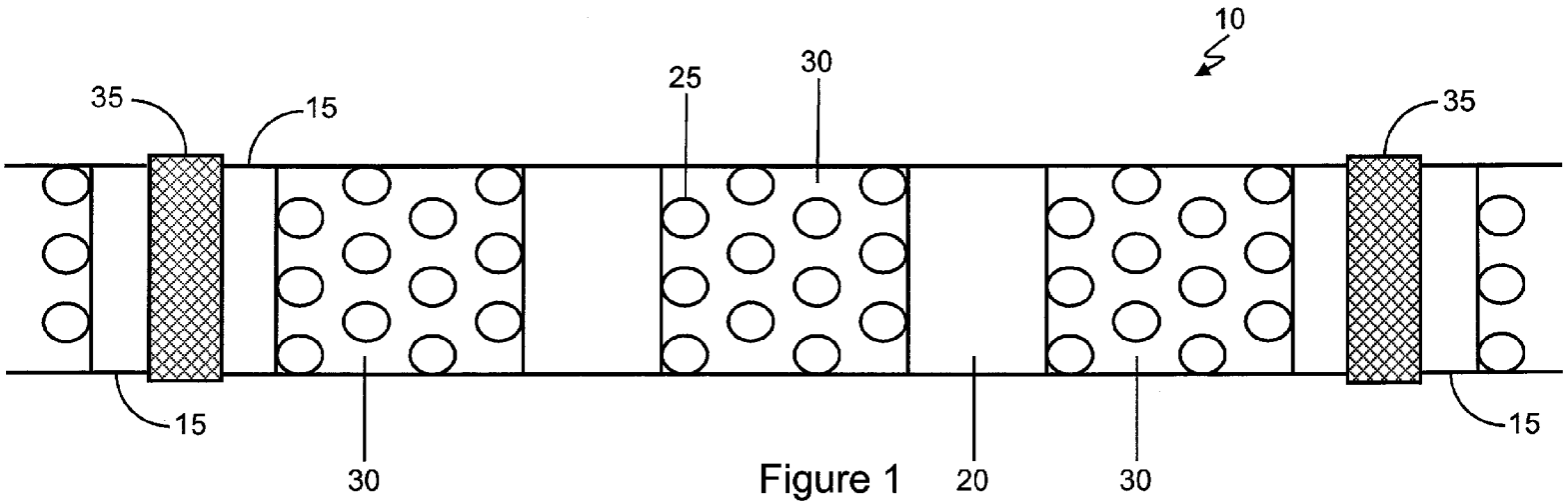
FIG. 1 is a sectional view of a well liner assembly (including well liner segment), according to an embodiment of the present invention.

The present invention relates to underground coal gasification.

Throughout this specification, unless the context requires otherwise, the words "comprise", "comprises" and "comprising" will be understood to mean the inclusion of a stated integer, group of integers, step, or steps, but not the exclusion of any other integer, group of integers, step, or steps.

In one aspect, the invention provides a well liner segment for use in the construction of an underground coal gasification well liner assembly, the segment including a UCG product gas-conveying pipe having opposed open ends for connection to like well liner segments and perforations located between the opposed open ends.

The UCG product gas-conveying pipe can be of any suitable size, shape and construction, and can be made of any suitable material or materials. The pipe can be manufactured in shapes and sizes to suit the specific application. Preferably, the pipe has a round cross-section to provide an annular passage, although other cross-section shapes are possible, as will be understood by one of ordinary skill in the art.

The UCG product gas-conveying pipe can be of any suitable length, including, meters and tens of meters. Accordingly, well liner segments can be connected together to form a well liner assembly being tens of meters long, hundreds of meters long, or even several kilometers in length, depending on the length of the wellbore. Each UCG product gas-conveying pipe can be, for example, about 1 to 12 meters in length, including about 2, 3, 4, 5, 6, 7, 8, or 9 meters in length. Each pipe is preferably about 5 to 7 meters in length, more preferably about 6 meters in length.

The well liner segments can be connected together in any suitable way to form a well liner assembly. For example, the opposed open ends of each UCG product gas-conveying pipe can be threaded, and the well liner assembly can include one or more threaded collars for connecting the ends of adjacent well liner segments together. Alternatively, adjacent well liner segments can be welded together to form a well liner assembly.

The UCG product gas-conveying pipe can have an outer diameter (or width) appropriate for the wellbore into which it is being inserted. Typically, the pipe will have an outer diameter of anywhere between about 5 to 10 inches, more preferably about 5 to 8 inches, and even more preferably about 5.5 to 7 inches.

The well liner segments are preferably resistant to chemical attack from the products of coal gasification and pyrolysis (e.g., sulfur), as well as attack from the syngas itself (including CO, $H_2$, $CO_2$, and $H_2O$) which may be acidic.

The UCG product gas-conveying pipe can be made of any suitable material, including, for example, metal (including steel, such as carbon steel, and aluminium), fibreglass, carbon fibre, plastic, and combinations thereof.

The perforations located between the opposed open ends of the UCG product gas-conveying pipe can be of any suitable size, shape and arrangement as required to mitigate a number of technical and operational issues associated with a fully closed-in well liner assembly. For example, the perforations allow the ignition of a coal seam from within a wellbore using an ignition tool located within the well liner assembly to ignite the surrounding coal seam. Additionally, the perforations allow gas production flow to be re-established if one end of the well liner assembly is blocked for whatever reason. The perforations also allow some desorption of methane in gassy coal seams which can add to the calorific value of the product gas.

The perforations are preferably in periodic symmetry in both circumferential and axial directions. The perforations can be in the form of circular or other shaped holes (e.g., hexagonal or octagonal), or slots. The perforations can be, for example, circular having a diameter of about 10 mm to 25 mm, including about 12 mm, 15 mm, 18 mm, 20 mm, or 23 mm. The perforations can be in a rectangular or diamond-shaped grid pattern, or both, for example. Preferably, the perforations are in a staggered arrangement (diamond spacing) as this provides the well liner segment (and assembly) with the greatest structural integrity.

The UCG product gas-conveying pipe can have anywhere between about 10% to about 60% of its surface area in an open configuration (i.e., perforated), provided that the structural integrity of the well liner segment (and assembly) meets operational, in seam requirements. Although the perforations can include about 10%, about 15%, about 20%, about 25%, about 30%, about 35%, about 40%, about 45%, about 50%, about 55%, or about 60% of the UCG product gas-conveying pipe's surface area, about 10% to about 50% appears to be optimal as adequate structural integrity is retained by the well liner segment (and assembly).

The perforations in the UCG product gas-conveying pipe can be formed in any suitable way, including, for example, by laser cutting, mechanical drilling, and water jet cutting.

Preferably, the perforations are grouped together in one or more regions along the length of the well liner segment/assembly, alternating with non-perforated sections.

In one embodiment, a well liner segment/assembly near an injection well will optimally include a UCG product gas-conveying pipe made of K55 carbon steel, with an outer diameter of about 5.5 inches, a wall thickness of about 0.275 inches, a nominal inside diameter of about 4.95 inches, and about 20-40% of its surface area in an open configuration (i.e., perforated).

In another embodiment, a well liner segment/assembly near a production well will optimally include a UCG product gas-conveying pipe made of L80 carbon steel, with an outer diameter of about 7 inches, a wall thickness of about 0.317 inches, a nominal inside diameter of about 6.366 inches, and about 20-40% of its surface area in an open configuration (i.e., perforated).

The well liner segment can further include a sheath configured to cover some or all of the perforations located between the opposed open ends of the UCG product gas-conveying pipe. For example, a sheath can be utilised to cover the perforations that are grouped together in one or more regions along the length of the pipe, leaving the intervening non-perforated sections of the pipe uncovered.

As will be understood by one of ordinary skill in the art, the sheath can stop the ingress of water and debris into the well liner assembly, prevent injected oxidant from exiting the assembly if it is not close to the active gasification zone/cavity, and serve as an accelerant during ignition of the coal seam.

The sheath can be of any suitable size, shape, and construction, as required by the well liner segment, and can be made of any suitable material or materials, including, for example, metal (including steel, such as carbon steel, and aluminium), fibreglass, carbon fibre, plastic, and combinations thereof. The sheath can be about 0.8 meters to about 1.5 meters in length, and about 1 mm to about 20 mm thick, including about 2 mm, about 5 mm, about 10 mm, or about 15 mm thick.

The sheath can be, for example, a membrane, sheet, or film that wraps around the outer diameter or the inner diameter of a well liner segment at least once and covers some or all of the perforations located between the opposed open ends of the UCG product gas-conveying pipe.

In one embodiment, the well liner segment includes a UCG product gas-conveying pipe made of metal and a combustible sheath configured to cover some or all of the perforations located between the opposed open ends of the pipe. Such a sheath can be made of any suitable combustible material, including plastic or fibreglass, and acts as an accelerant during ignition of the coal seam.

Preferably, the combustible sheath is made of high density polyethylene (HDPE). The HDPE sheath can have a thickness of about 10 mm.

In another embodiment, the sheath is made of a material with a low melting temperature, so that it degrades quickly upon commencement of the ignition process in the coal seam. For example, the sheath can be made of aluminium.

The sheath can be attached to or associated with the UCG product gas-conveying pipe in any suitable way. For example, fasteners, such as screws, ring clamps, or straps (including stainless steel straps), can be used to bind the sheath to the pipe. Additionally, the sheath can be welded to the pipe or integrated into it (e.g., sandwiched into a double-layer well liner segment).

Alternatively, where the sheath is made of plastic, it can be hot-rolled in place around the outer diameter or the inner diameter of the UCG product gas-conveying pipe, particularly in association with some or all of the perforations located between the opposed open ends of the pipe (i.e., the sheath covers the perforations).

The well liner segment can include associated instrumentation such as one or more sensors for sensing and reporting conditions in the well liner assembly, the wellbore, and/or the surrounding coal seam. Any suitable type of sensor can be used. For example, the sensor can be a thermocouple for sensing the temperature, a gas sensor for sensing the nature of the product gas, a pressure sensor for sensing pressure, an optical sensor for viewing the well liner assembly and/or the wellbore, or a position sensor for reporting the location of the well liner segment/assembly within the wellbore or the location of one or more tools in the lined wellbore.

The associated instrumentation can be connected to the well liner segment in any suitable way. For example, the perforations in the UCG product gas-conveying pipe can be used in the connection of the associated instrumentation.

In one embodiment, the well liner assembly includes a string of thermocouples connected to a well liner segment or sheath (or embedded within a well liner segment or sheath) so that temperature information is collected from the well liner assembly at multiple points (particularly during operation of the gasifier). This temperature information can indicate the performance of the underground gasification process and can be used to control the operating parameters of the gasifier.

The well liner assembly can further include a firebreak material connected to one or more of the well liner segments or forming part of the well liner assembly (e.g., a well liner segment constructed of the firebreak material). Exemplary firebreak material includes, but is not limited to, stainless steel, and the Inconel® (predominantly nickel-chromium alloys), Monel (predominantly nickel-copper alloys), and Hastelloy® (predominantly nickel-containing alloys) families of high-performance alloys.

The firebreak material and/or well liner segment constructed of firebreak material can be positioned adjacent the heel of the injection well. The well liner assembly can include firebreak material connected to the well liner assembly at one or more locations along its length. Alternatively, the well liner assembly can include one or more well liner segments constructed of firebreak material interspersed along the length of the well liner assembly.

In another aspect, the invention provides an underground coal gasification well liner assembly including two or more well liner segments as set forth herein connected to one another.

Preferably, the well liner assembly is strong enough to be inserted into a wellbore (i.e., extended within a coal seam between an injection well and a production well) using traditional drilling service equipment, as will be well known to one of ordinary skill in the art.

Preferably, the well liner assembly extends from adjacent a heel of the injection well to adjacent a heel or toe of the production well.

Preferably, the UCG product gas-conveying pipe of each segment of the well liner assembly is large enough to receive and convey an ignition tool along its length, for use in a controlled retracting injection point (CRIP) gasifier.

In a further aspect, the invention provides a method of underground coal gasification in a coal seam provided with an injection well, a production well and an in-seam channel linking the injection well and the production well, including the steps of: a) extending at least one well liner assembly as defined herein within the coal seam between the injection well and the production well, b) igniting the coal seam using an ignition tool located within the well liner assembly, c) injecting oxidant into the linkage channel to maintain combustion of the coal seam, and d) withdrawing product gas from the production well.

In one embodiment, the coal seam is further provided with one or more service wells.

As will be understood by one of ordinary skill in the art, the step of igniting the coal seam preferably includes using an ignition tool, whereby an ignition tool that includes ignition means is inserted into the coal seam via the injection well, a service well, and/or the production well. Once introduced into the coal seam, the ignition tool is used to ignite the coal seam and establish a combustion zone. The ignition tool can be positionable and retractable, so that ignition (including re-ignition) of the coal seam and the formation of combustion zones can be established in sequence. A preferred method is utilising the CRIP concept.

Positioning of the ignition tool can be achieved utilising coiled tubing connected to the ignition tool and extendible within the lined wellbore to position the ignition tool at a desired location within the wellbore.

The ignition tool can ignite the coal seam in any suitable way. For example, where the well liner assembly inserted into the wellbore is made of a combustible material, the ignition tool can indirectly ignite the coal seam via primary ignition of the combustible liner.

Where the well liner assembly inserted into the wellbore includes one or more perforated sections, the ignition tool can directly ignite the coal seam at any one of the perforated sections.

Alternatively, where the well liner assembly inserted into the wellbore includes one or more perforated sections and an accompanying combustible sheath configured to cover some or all of perforations, the ignition tool can indirectly ignite the coal seam via primary ignition of the combustible sheath.

In one embodiment, the ignition means includes an electrical spark generator (e.g., a spark plug) and a power supply for generating the spark. The power supply can be located above ground or the spark generator can be powered by an in-seam turbine and transformer electrically connected to the spark generator.

In another embodiment, the ignition means includes an electrical heat resistor (e.g., a glow plug) and a power supply for electrifying the resistor. The resistor can, for example, generate about 180 kW of heat. The power supply can be located above ground or the electrical heat resistor can be powered by an in-seam turbine and transformer electrically connected to the resistor.

In a further embodiment, the ignition means includes at least one type of ignition chemical. The ignition chemical can be a pyrophoric substance (e.g., a liquid, such as triethylboron (TEB), a gas, such as silane, a solid, such as phosphorus or an alkali metal), a pyrophoric substance and a hydrocarbon mixture, such as TEB vaporised in methane, or a pyrophoric substance and an inert gas, such as TEB and nitrogen. The hydrocarbon or inert gas flow can help transport/vaporise the pyrophoric substance to the ignition tool.

Once the coal seam has been ignited (or re-ignited), the ignition tool is retracted to a safe distance within the wellbore and an oxidant is injected into the wellbore through an injection well to fuel/maintain combustion of the coal seam. Alternatively, the ignition tool can be withdrawn from the wellbore following successful ignition (or re-ignition) of the coal seam.

The oxidant is preferably a gas such as air (approximately 20% oxygen), oxygen-enriched air (greater than 20% oxygen), or a gas/gas mixture (e.g., carbon dioxide and/or nitrogen in any desired ratio) enriched with oxygen (greater than 20% oxygen), or substantially pure oxygen. The oxidant source can include an air compressor, a tank/cylinder of compressed air or oxygen, an air separation unit, or a tank/cylinder of liquid oxygen, for example.

In yet a further aspect, the invention provides a system for UCG product gas production, including: a) an underground coal seam, b) at least one injection well, c) at least one production well, d) an in-seam channel linking the injection well and the production well, and e) a well liner assembly including two or more well liner segments as set forth herein connected to one another.

In another aspect, the invention provides an underground coal gasification well liner assembly having two or more well liner segments connected to one another, wherein each well liner segment includes: a) a UCG product gas-conveying pipe having opposed open ends for connection to like well liner segments and perforations located between the opposed open ends, and b) a sheath.

In one embodiment, the perforations are grouped together in one or more regions along the length of the UCG product gas-conveying pipe, alternating with non-perforated sections of the pipe.

In the figures, like reference numerals refer to like features.

Referring to FIG. 1, there is generally depicted a well liner assembly 10 (including well liner segment 15), according to an embodiment of the present invention. Suitably, well liner assembly 10 is located adjacent an injection well of a UCG gasifier.

Each well liner segment 15 of the well liner assembly 10 includes a UCG product gas-conveying pipe 20 having opposed open ends for connection to like well liner segments 15. The UCG product gas-conveying pipe 20 is capable of remaining structurally intact within an underground coal seam and conveying UCG product gas to a production well. Each UCG product gas-conveying pipe 20 includes perforations 25 located between the opposed open ends.

The UCG product gas-conveying pipe 20 is made of K55 carbon steel, has an outer diameter of about 5.5 inches, a wall thickness of about 0.275 inches, a nominal inside diameter of about 4.95 inches, and a length of between 6.10 and 6.30 meters. The UCG product gas-conveying pipe 20 has a melting temperature of between about 1450° C. and 1500° C.

The perforations 25 located between the opposed open ends of the UCG product gas-conveying pipe 20 have 25 mm openings formed by laser cutting. The perforations 25 are in periodic symmetry in both circumferential and axial directions on the UCG product gas-conveying pipe 20, and are in a staggered arrangement as this provides the pipe 20 with the greatest structural integrity. The perforations 25 account for approximately 20% to 40% of the UCG product gas-conveying pipe's 20 surface area. The perforations 25 are grouped together in sections 30 along the length of the UCG product gas-conveying pipe 20.

Each end of the UCG product gas-conveying pipe 20 is externally threaded and the well liner assembly 10 has internally threaded collars 35 for connecting the ends of the pipes 20 together.

Figure 2:
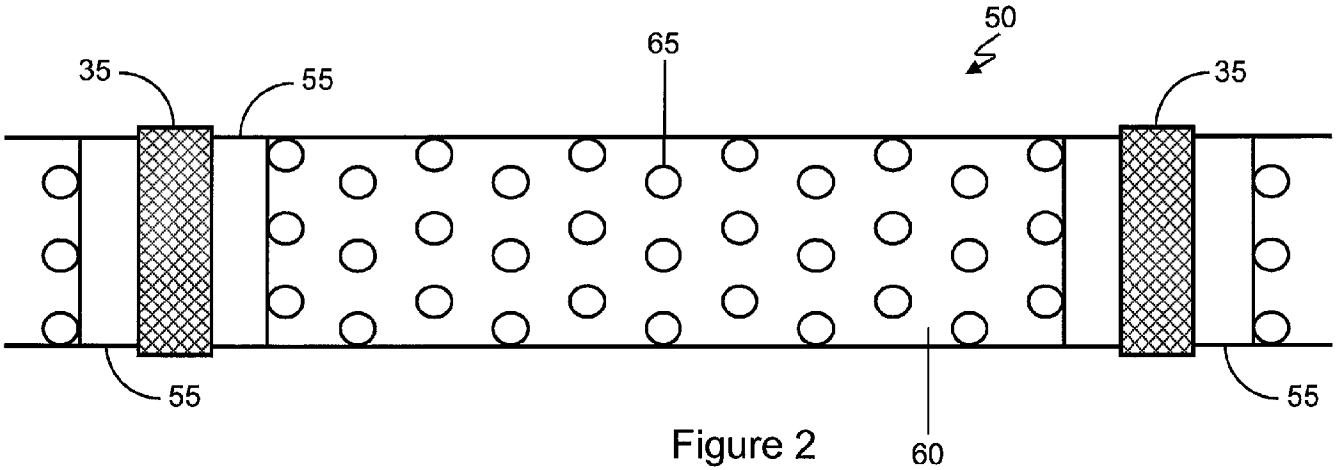
FIG. 2 is a sectional view of an alternate well liner assembly (including alternate well liner segment), according to another embodiment of the present invention.

Turning to FIG. 2, there is generally depicted an alternate well liner assembly 50 (including alternate well liner segment 55), according to an embodiment of the present invention. Suitably, well liner assembly 50 is located adjacent a production well of a UCG gasifier.

Each well liner segment 55 of the well liner assembly 50 includes a UCG product gas-conveying pipe 60 having opposed open ends for connection to like well liner segments 55. The UCG product gas-conveying pipe 60 is capable of remaining structurally intact within an underground coal seam and conveying UCG product gas to a production well. Each UCG product gas-conveying pipe 60 includes perforations 65 located between the opposed open ends.

The UCG product gas-conveying pipe 60 is made of L80 carbon steel, has an outer diameter of about 7.0 inches, a wall thickness of about 0.317 inches, a nominal inside diameter of about 6.366 inches, and a length of between 5.80 and 6.0 meters. The UCG product gas-conveying pipe 60 has a melting temperature of between about 1450° C. and 1500° C.

The perforations 65 located between the opposed open ends of the UCG product gas-conveying pipe 60 have 13 mm openings formed by laser cutting. The perforations 65 are in periodic symmetry in both circumferential and axial directions on the UCG product gas-conveying pipe 60, and are in a staggered arrangement as this provides the pipe 60 with the greatest structural integrity. The perforations 65 account for approximately 10% of the UCG product gas-conveying pipe's 60 surface area.

Each end of the UCG product gas-conveying pipe 60 is externally threaded and the well liner assembly 50 has internally threaded collars 35 for connecting the ends of the pipes 60 together.

The perforations 65 in the UCG product gas-conveying pipe 60 allow gas production flow to be re-established if one end of the pipe 60 is blocked for whatever reason. The perforations 65 also allow some desorption of methane in gassy coal seams which can add to the calorific value of the UCG product gas.

Figure 3:
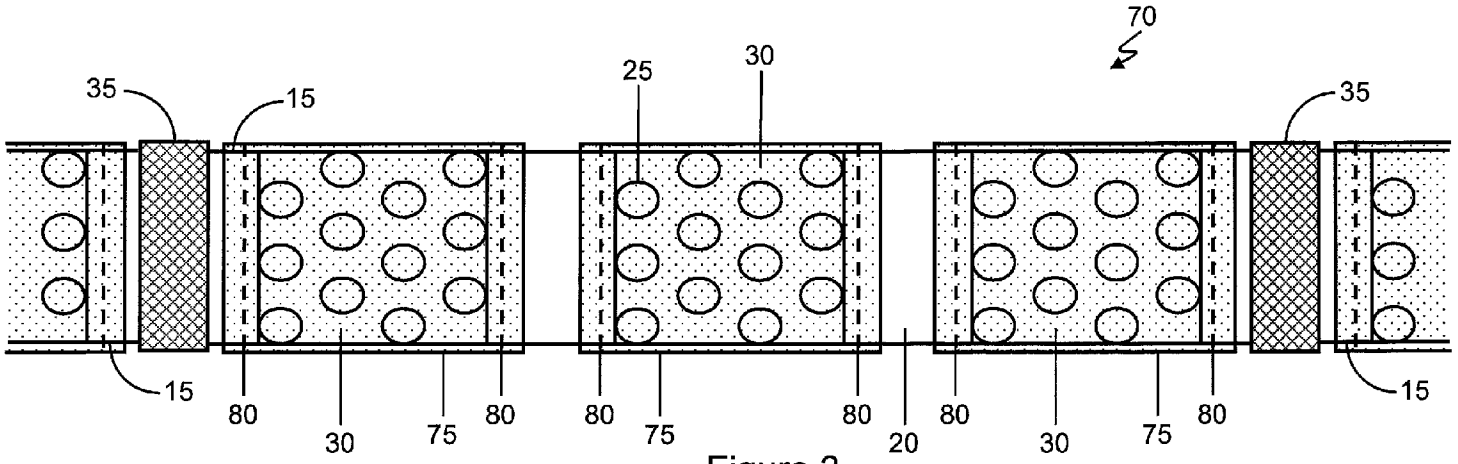
FIG. 3 is a sectional view of a well liner assembly (including well liner segment) having a sheath, according to a further embodiment of the present invention.

Referring to FIG. 3, there is generally depicted a well liner assembly 70 (including well liner segment 15), according to an embodiment of the present invention. Suitably, well liner assembly 70 is located adjacent an injection well of a UCG gasifier.

Each well liner segment 15 of the well liner assembly 70 includes a UCG product gas-conveying pipe 20 having opposed open ends for connection to like well liner segments 15 and a sheath 75.

The sheath 75 is made of high density polyethylene, which has a heat content of about 44 MJ/kg and a combustion temperature of about 280° C. The HDPE sheath 75 is hot-rolled into about a 10 mm thick cylinder of about 1.10 meters in length and strapped into place around the UCG product gas-conveying pipe 20 (covering the perforations 25) with stainless steel straps 80 (only some of which are shown). The stainless steel straps 80 ensure that the sheath 75 does not move when the well liner assembly 70 is inserted downhole into a coal seam. Three HDPE sheaths 75 are strapped to each UCG product gas-conveying pipe 20.

The sheath 75 stops the ingress of water and debris into the UCG product gas-conveying pipe 20, and acts as an accelerant during ignition of the coal seam.

Figure 4:
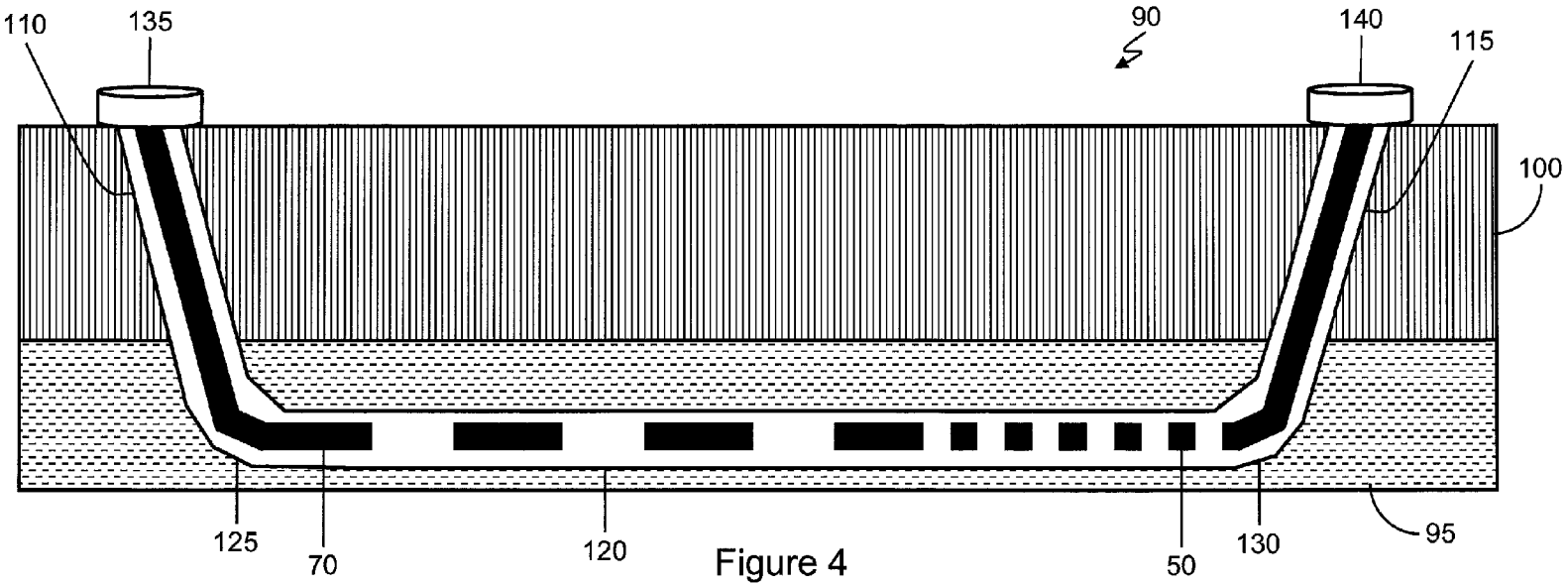
FIG. 4 is a side section view of a system for UCG product gas production, according to another embodiment of the present invention.

Turning to FIG. 4, there is generally depicted a system 90 for UCG product gas production, according to an embodiment of the present invention.

A coal seam 95 is located under overburden 100, and includes an injection well 110 and a production well 115. A wellbore/in-seam linkage channel 120 extends through the coal seam 95, linking the injection well 110 and the production well 115. A well liner assembly 70 extends from a firebreak segment (not shown) adjacent the heel 125 of injection well 110, while a well liner assembly 50 extends from adjacent the heel 130 of production well 115. The well liner assemblies 50 and 70 are connected together to form a continuous well liner assembly.

In use, the well liner assemblies 50 and 70 are placed downhole in the wellbore 120 having a diameter of about 8.75 inches. The UCG product gas-conveying pipe 20 is dimensioned to accommodate a retractable ignition tool (e.g., an ignition tool that that includes ignition means located at the end of coiled tubing). The ignition tool provides a source of heat for combusting/degrading the sheath 75 and igniting the coal seam 95, prior to retraction towards the injection well 110 (where it may be used to ignite another part of the coal seam 95). Thermocouples of the well liner assembly 70 monitor the downhole temperature, and once the coal seam 95 has been ignited, oxidant is introduced into the wellbore 120 via a well head 135 of the injection well 110.

The well liner assembly 70 adjacent the injection well 110 ensures that the pathway for oxidant injection remains open and unobstructed, and ensures that the coal seam can be ignited/re-ignited.

The well liner assemblies 70 and 50 keep the horizontal wellbore 120 from total blockage during coal spalling, and maintain a clear path for oxidant flow along the length of the well liner assemblies 70 and 50. The sheaths 75 of well liner assembly 70 close to the gasification zone will simply burn away due to the perforations 25, allowing for easy re-ignition options through these perforations 25.

Gasification occurs within a gasification zone adjacent a combustion zone of the well/gasifier, and hot product gas flows from the gasification zone and exits the ground via a well head 140 of the production well 115.

The well liner assembly 50 adjacent the production well 115 ensures that the pathway to the production well 115 for product gas remains open and unobstructed.

In summary, the well liner assembly according to the present invention minimises or overcomes one or more of the inherent problems of UCG.

Throughout the specification the aim has been to describe the preferred embodiments of the invention without limiting the invention to any one embodiment or specific collection of features. It will therefore be appreciated by those of skill in the art that, in light of the instant disclosure, various modifications and changes can be made in the particular embodiments exemplified without departing from the scope of the present invention.

The invention claimed is:

1. A well liner segment for use in the construction of an underground coal gasification (UCG) well liner assembly, the segment comprising a UCG product gas-conveying pipe having opposed open ends for connection to like well liner segments and perforations located between the opposed open ends, wherein the perforations are grouped together in one or more regions along the length of the UCG product gas-conveying pipe, alternating with non-perforated sections of the pipe, and wherein the UCG product gas-conveying pipe is made of metal and the well liner segment further comprises a combustible sheath.

2. The well liner segment of claim 1, wherein the UCG product gas-conveying pipe is made of aluminium.

3. The well liner segment of claim 1, wherein the combustible sheath is made of high density polyethylene.

4. The well liner segment of claim 1, wherein the combustible sheath covers at least some of the perforations in the UCG product gas-conveying pipe.

5. An underground coal gasification well liner assembly comprising two or more well liner segments as set forth in claim 1 connected to one another.

* * * * *